US007510372B2

(12) United States Patent
Bogue et al.

(10) Patent No.: US 7,510,372 B2
(45) Date of Patent: Mar. 31, 2009

(54) WEDGE REPAIR OF MECHANICALLY RETAINED VANES

(75) Inventors: William Bogue, Hebron, CT (US); Richard B. Ringler, Middletown, CT (US)

(73) Assignee: United Technologies Corporation, Hartford, CT (US)

( * ) Notice: Subject to any disclaimer, the term of this patent is extended or adjusted under 35 U.S.C. 154(b) by 353 days.

(21) Appl. No.: 11/407,554

(22) Filed: Apr. 19, 2006

(65) Prior Publication Data

US 2007/0248463 A1 Oct. 25, 2007

(51) Int. Cl.
*F01D 5/30* (2006.01)

(52) U.S. Cl. ..... 415/191; 415/209.3; 415/209.4; 416/219 R; 416/241 A

(58) Field of Classification Search ..... 415/191, 415/208.1, 209.2–4, 210.1, 211.2; 416/219 R, 416/241 A See application file for complete search history.

(56) References Cited

U.S. PATENT DOCUMENTS

| | | | | | |
|---|---|---|---|---|---|
| 2,857,093 | A | * | 10/1958 | Warnken | 415/209.3 |
| 3,339,833 | A | * | 9/1967 | Bill et al. | 416/219 R |
| 3,778,185 | A | * | 12/1973 | Plowman et al. | 415/209.4 |
| 4,728,258 | A | * | 3/1988 | Blazek et al. | 415/137 |
| 5,074,752 | A | * | 12/1991 | Murphy et al. | 415/209.4 |
| 5,083,900 | A | * | 1/1992 | Carletti et al. | 415/209.3 |

* cited by examiner

*Primary Examiner*—Igor Kershteyn
(74) *Attorney, Agent, or Firm*—Bachman & LaPointe, P.C.

(57) ABSTRACT

A method for repairing or replacing a mechanically retained vane is provided. The method comprises the steps of forming an oversized cavity in a support structure, inserting a flared end of a vane in the oversized cavity, and inserting a wedge for mechanically retaining the flared end of the vane in the oversized cavity.

15 Claims, 2 Drawing Sheets

WEDGE REPAIR OF MECHANICALLY RETAINED VANES

BACKGROUND OF THE INVENTION (1) Field of the Invention

The present invention relates a method for replacing outer bases for vane assemblies with mechanically retained vanes and a turbine engine component resulting from the method.

(2) Prior Art

As shown in FIGS. 1 and 2, an outlet guide vane assembly 10 used in gas turbine engines has an inner composite base 12 and an outer composite base 14 that positions a composite vane airfoil 16 during service. The assembly is bolted to the inner diameter of a cylindrical metal case (not shown) by three bolts extending thru the case and the outer base. The inner base is bonded to the vane airfoil and is inseparable without destroying the inner base. The outer base to vane end interface incorporates mechanical retention where the vane end 18 is flared and the vane cavity 20 in the outer base 14 pinches. The vane airfoil is both bonded to and mechanically retained by the outer base. The result is that the vane 22 cannot fall through the base 14 without material rupture of the base and/or vane. The metallic case (not shown) prevents movement of the flared vane end 18 in the outboard direction.

The mechanical retention feature prevents installation of replacement outer base detail without complete removal and replacement of the inner base 12 because neither the inner base, nor the flared vane end 18 can fit through the pinched vane cavity 20.

The outer base is the feature most prone to impact and flexural damage as a result of fan blade centrifuged objects and fan case flexure. Accordingly, there is a need for an improved method for replacing damaged outer bases for the mechanically retained vane assemblies.

SUMMARY OF THE INVENTION

In accordance with the present invention, there is provided a method for repairing or replacing a mechanically retained vane. The method broadly comprises the steps of forming an cavity in a support structure oversized sufficiently to insert the flared end of a vane through the oversized cavity; installing wedges between the base and vane end from the opposite side of the outer base; pulling vane end and wedges to rest against the oversized vane cavity, leaving sufficient space for application of bonding adhesive.

Further, in accordance with the present invention, there is provided a turbine engine component comprising a support structure, a cavity within the support structure, at least one airfoil surface having an end positioned within the cavity, and means positioned within the cavity for mechanically retaining the end of the at least one airfoil surface within the cavity.

Other details of the wedge repair of mechanically retained vanes, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
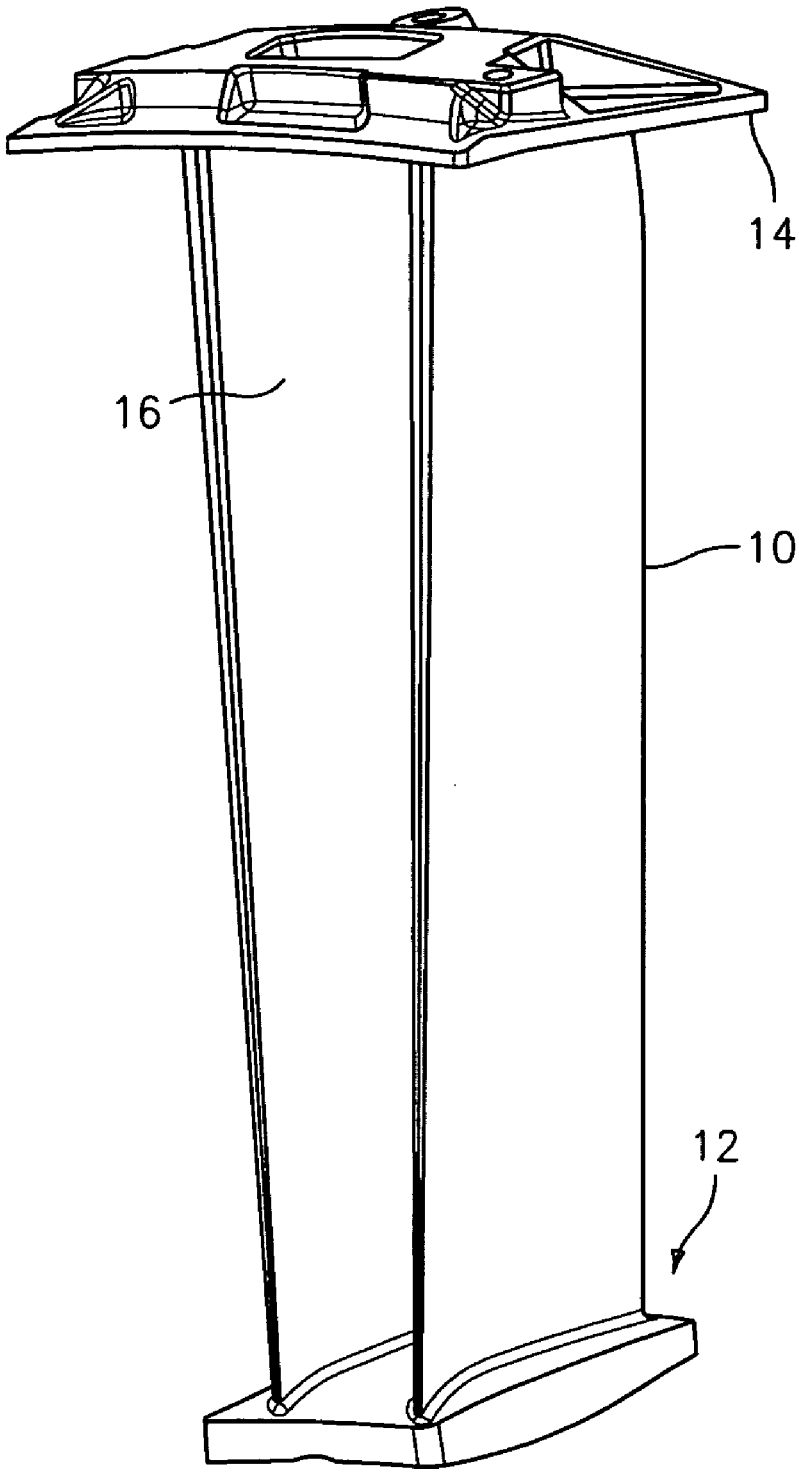
FIG. 1 is a perspective view of an outlet guide vane assembly used in a gas turbine engine.
Figure 2:
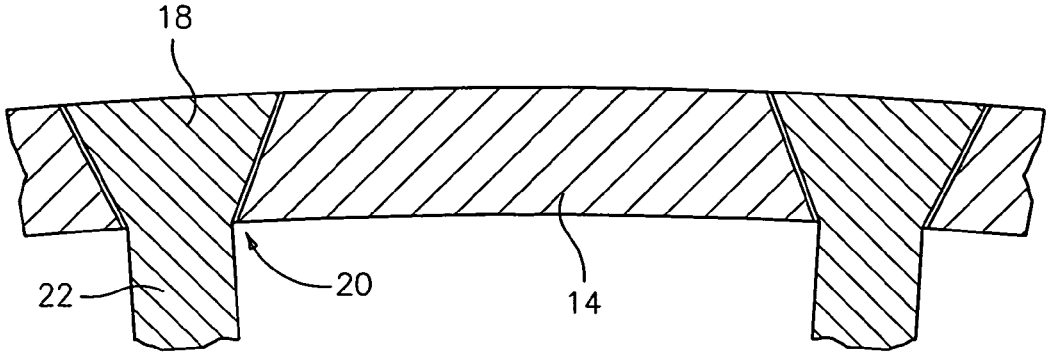
FIG. 2 is a sectional view of a prior art mechanical retention system for positioning airfoil surfaces of a vane used in the outlet guide vane of FIG. 1.
Figure 3:
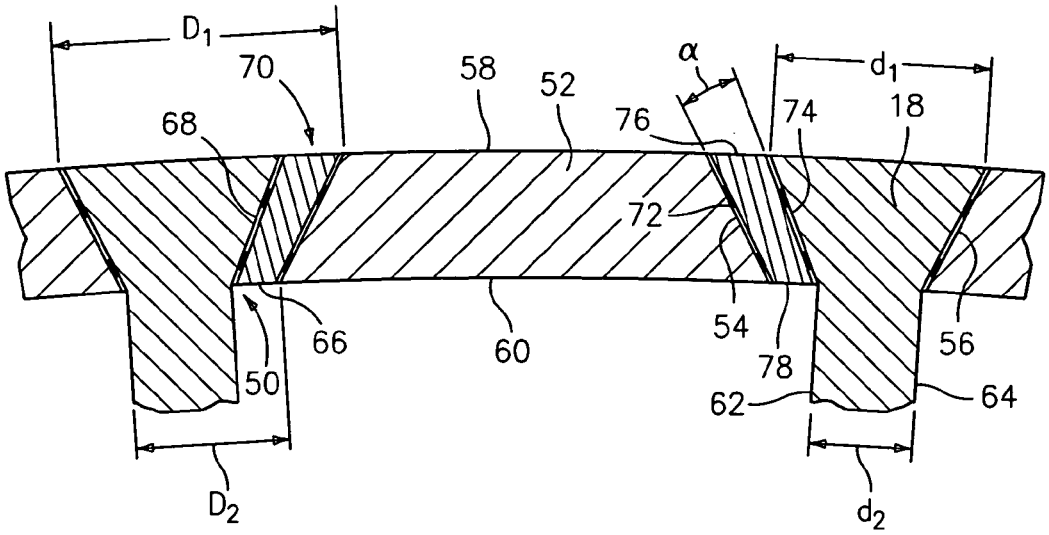
FIG. 3 is a sectional view of a mechanical retention system for positioning airfoil surfaces of a vane used in the outlet guide vane of FIG. 1 in accordance with the present invention.

Referring now to FIG. 3, there is shown a mechanical retention system for positioning airfoil surfaces of a vane in a turbine engine component such as an outlet guide vane assembly.

The mechanical retention system comprises an oversized pinched cavity 50 machined or molded into a curved support structure 52 of a turbine engine component 10, such as the outer composite base 14 of an outlet guide vane. The cavity 50 preferably has side walls 54 and 56 which converge from the outboard edge 58 of the support structure 52 to the inboard edge 60 of the support structure 52. The cavity 50 is sized so that a flared end 18 of a vane airfoil 22 may be installed through the pinched end of the cavity 50. Mechanical retention in the opposite direction may be maintained by a case wall (not shown).

The end 18 of the vane 22 is located within the oversized cavity 50 so as to position the airfoil surfaces 62 and 64 of the vane airfoil 22. The vane end 18 is flared so as to have a first cross-sectional dimension $d_1$ adjacent the outboard edge 58 and a second cross-sectional dimension $d_2$ adjacent the inboard edge 60. The second dimension $d_2$ is less than the first dimension $d_1$ and there is a transition of thickness between the outboard and inboard edges. The oversized cavity 50 is provided with a dimension $D_1$ adjacent the outer edge 58 and with a dimension $D_2$ adjacent the inner edge 60. $D_1$ is greater than both $D_2$ and $d_1$. $D_2$ is greater than $d_2$. As a result, there is a space 66 between a side wall 54 or 56 of the cavity 50 and a side wall 68 of the flared end 18.

The vane end 18 is inserted through the inboard opening of the cavity (Dimension D2). In order to retain the end 18 in place, a wedge detail 70 is inserted into the space 66. The wedge detail 70 is installed from the large end of the cavity 50. The wedge detail 70 may be contoured to occupy the space 66 which is the difference between the oversize of the cavity 50 and the flared vane end 18. The wedge detail 70 preferably has two side walls 72 and 74 which converge from the outer end 76 to the inner end 78. In a preferred embodiment of the present invention, the side walls 72 and 74 form a taper angle $\alpha$ in the range of 3.0 degrees to 7.0 degrees to allow adaptation of the repair for any tolerance variations in the vane end, or outer base. The wedge detail 70 may be formed from any suitable material known in the art, but in a preferred embodiment, it is fabricated from the same material as the outer base. For example, the wedge detail 70 may be formed from a non-metallic material such as polyurethane, a high performance, glass fiber reinforced engineering composite molding compound such as the material sold under the trade name LYTEX, nylon, or a polyetherimide such as the material sold under the trade name ULTEM.

In a preferred embodiment of the present invention, the support structure 52, the wedge detail 70, and the vane end 18 are both mechanically and adhesively secured. Any adhesive compatible with the base, vane and wedge materials known in the art may be used to adhesively secure these elements together.

In order to repair or replace an outer base in a turbine engine component, the oversized cavity 50 is first machined or formed in a support structure 52 of the turbine engine component 10. The flared end 18 of a vane 22 is then positioned within the oversized cavity 50. An adhesive material in a suitable form may be applied to the walls of the flared end 18 of the vane and to the walls 54 and 56. The adhesive material may also be applied to the walls 72 and 74 of the wedge detail 70. Thereafter, the wedge detail 70 is installed from the large end of the cavity 50. As a result, the mechanical retention that was present in the original turbine engine component 10 is restored. Either the support structure 52, the vane end 18 or the wedge detail 70 must rupture for the vane end 18 to be pulled through the base 52.

One of the advantages of the present invention is that the mechanical retention is maintained, but complete disassembly of the vane and inner bases is not required. This allows for reduced tooling and inspection requirements without degradation of technical merit. Additionally, for vane assemblies with more than one vane airfoil, the relative positioning of vanes is maintained by the inner base simplifying the assembly process and reducing the opportunity for incorrect positioning of the vanes in the finished assembly.

While the retention system of the present invention has been described as being used in connection with the positioning of airfoil surfaces of vanes in an outlet guide vane, it should be recognized that the retention system could be used in other turbine engine components to position surfaces of blades, vanes, and other radial elements.

It is apparent that there has been provided, in accordance with the present invention, a wedge repair of mechanically retained vanes which fully satisfies the objects, means, and advantages set forth hereinbefore. While the present invention has been described in the context of specific embodiments thereof, other unforeseeable alternatives, modifications, and variations may become apparent to those skilled in the art having read the foregoing description. Accordingly, it is intended to embrace those alternatives, modifications, and variations as fall within the broad scope of the appended claims.

What is claimed is:

1. A method which comprises the steps of forming a pinched oversized cavity having a pinched end and a large end in a support structure, inserting a flared end of a vane into said oversized cavity through said pinched end so that a first side of said flared end of said vane abuts a first interior edge of the cavity and a second side of said flared end of said vane is spaced from a second interior edge of the cavity, and inserting means for mechanically retaining said flared end of said vane in said oversized cavity through said large end of said cavity so that said mechanical retaining means abuts said second interior edge of said cavity and said second side of said flared end and so that an outer edge of said mechanical retaining means is flush with an outer edge of said support structure.

2. The method according to claim 1, wherein said forming step comprises forming a cavity having a larger dimension adjacent said outer edge of said support structure and a smaller dimension adjacent an inner edge of said support structure.

3. The method according to claim 2, wherein said inserting step comprises installing a wedge detail between a wall of said cavity and a wall of said flared end of said vane.

4. The method according to claim 3, wherein said installing step comprises installing said wedge detail into said large end of said cavity having said larger dimension.

5. The method of claim 1, further comprising applying an adhesive to walls of said cavity, walls of said flared end, and walls of said mechanical retention means so as to secure said flared end of said vane and said mechanical retention means to said side walls of said cavity and said support structure.

6. A turbine engine component comprising a support structure, a cavity within said support structure, said cavity having a first interior wall and a second interior wall, an airfoil surface having a flared end positioned within said cavity, said flared end having a first side which abuts said first interior wall and a second side which is spaced from said second interior wall and forms a gap with said second interior wall, and means positioned within said cavity for mechanically retaining said end of said at least one airfoil surface within said cavity, said mechanical retaining means being positioned within said gap and having a first side wall which abuts said second side of said flared end and a second side wall which abuts said second interior wall, and said mechanical retaining means further having an outer edge which is flush with an outer edge of said support structure when said mechanical retaining means is positioned within said gap.

7. The turbine engine component of claim 6, wherein said support structure has an inner edge and said cavity has a larger dimension adjacent said outer edge and a smaller dimension adjacent said inner edge and said cavity being larger than said flared end.

8. The turbine engine component of claim 7, wherein said mechanical retaining means comprises a wedge detail positioned between a side wall of said cavity and a wall of said flared end and said wedge detail has an outer edge which is flush with said outer edge of said support structure and an inner edge which is flush with said inner edge of said support structure.

9. The turbine engine component of claim 8, wherein said vane, wedge and support structure are formed from non-metallic materials.

10. The turbine engine component of claim 8, wherein said wedge detail is formed from a non-metallic material selected from the group consisting of polyurethane, a high performance, glass fiber reinforced engineering composite molding compound, nylon, and a polyetherimide material.

11. The turbine engine component of claim 8, wherein said wedge detail has said outer edge, an inner edge, said first side wall connecting said outer edge and said inner edge, and said second side wall connecting said outer edge and said inner edge, and said first and second side walls forming a taper angle in the range of from 3.0 to 7.0 degrees.

12. The turbine engine component of claim 8, further comprising an adhesive material for joining said wedge detail to said flared end, for joining said flared end to said support structure, and for joining said wedge detail to said support structure.

13. The turbine engine component according to claim 6, wherein said component comprises an outlet guide vane.

14. The turbine engine component according to claim 6, wherein said support structure comprises an outer base of an outlet guide vane, said outlet guide vane has an inner base and said vane extends between said inner base and said outer base.

15. A wedge detail for use in replacing or repairing turbine engine components, said wedge detail being formed from a non-metallic material and having a first side wall and a second side wall forming a taper angle in the range of from 3.0 to 7.0 degrees with respect to said first side wall.

* * * * *